United States Patent [19]

Mathews et al.

[11] Patent Number: 4,878,037

[45] Date of Patent: Oct. 31, 1989

[54] FLANGE CONNECTION USING A RADIALLY ELASTIC CENTERING RING

[75] Inventors: Hans-Günter Mathews, Oberehrendingen; Oskar Schafheitle, Oetwil a.d.L., both of Switzerland

[73] Assignee: BBC Brown Boveri AG, Baden, Switzerland

[21] Appl. No.: 233,826

[22] Filed: Aug. 19, 1988

[30] Foreign Application Priority Data

Aug. 20, 1987 [DE] Fed. Rep. of Germany ..... 3727797

[51] Int. Cl.[4] ..... H01P 1/04

[52] U.S. Cl. ..... 333/254; 285/235; 285/412; 285/414

[58] Field of Search ..... 333/254, 257; 285/235, 285/368, 412, 414, 415

[56] References Cited

U.S. PATENT DOCUMENTS

| | | | |
|---|---|---|---|
| 1,295,263 | 2/1919 | Blom | 285/414 X |
| 3,034,808 | 5/1962 | Poundstone | 285/235 |
| 3,414,297 | 12/1968 | Pollia | 285/415 X |
| 3,778,799 | 12/1973 | Bendayan | 333/248 X |
| 4,488,743 | 12/1984 | Schulke | 285/415 X |

FOREIGN PATENT DOCUMENTS

| | | | |
|---|---|---|---|
| 1441678 | 3/1971 | Fed. Rep. of Germany . | |
| 2030338 | 11/1972 | Fed. Rep. of Germany . | |
| 2720239 | 11/1977 | Fed. Rep. of Germany | 333/254 |

OTHER PUBLICATIONS

International Electrotechnical Commission (Affiliated to the International Organization for Standardization-ISO) Pub. 154-4.

*Primary Examiner*—Paul Gensler

*Attorney, Agent, or Firm*—Oblon, Spivak, McClelland, Maier & Neustadt

[57] ABSTRACT

A flange connection for round waveguides achieves a high-accuracy coaxiality of two round mutually adjoining waveguides (1*a*, 1*b*) by means of a radially elastic centering ring (3). The flange connection comprises two independent flange rings (2*a*, 2*b*) which are in each case attached to one end of the waveguides (1*a*, 1*b*), in which arrangement they are attached so as to be undisplaceable in the axial direction for a construction of the flange connection but to be freely rotatable around the respective waveguide. According to a preferred embodiment of the invention, the flange rings (2*a*, 2*b*) are constructed in such a manner that the flange connection can be joined in the manner of a bayonet lock.

15 Claims, 2 Drawing Sheets

87/075

87/075

FLANGE CONNECTION USING A RADIALLY ELASTIC CENTERING RING

BACKGROUND OF THE INVENTION

1. Field of the Invention

The invention relates to a flange connection for round waveguides.

2. Discussion of Background

In connection with fusion research, the generation and the guidance of high-power microwaves are highly important since electromagnetic radiation can be used for heating the plasma. In this connection, frequencies within the range of some GHz to some hundred GHz are preferably used. Correspondingly, the required over-dimensioned waveguides have transverse dimensions of a few dozen to some centimeters. They are frequently circular in cross-section.

In principle, a waveguide has the task of conducting the electromagnetic waves from the location where they are generated to the location where they are used and to do that, if possible, without changing the type and intensity of the waves. The extent to which a waveguide can fulfill its task essentially depends on how constant its cross-section is. Abrupt changes in the cross-section, such as mainly occur when waveguides are connected at the front ends, lead, for example, to mode conversion and have a particularly disturbing effect. This is why it is important that the production tolerances of the waveguides are as small as possible (for example with respect to their cross-sectional shape) and that they are coaxially connected with high accuracy.

For coupling round waveguides, a flange connection is known from ISO Standard, publication 154-4, "Flanges for wave guides". In this arrangement, flanges are attached to the ends of the waveguides, for example by soldering, which are pressed against one another by two meshing toothed rings which are slipped over the flanges and are screwed against one another.

The great disadvantage of this flange connection lies in the fact that it is not possible to achieve coaxiality of the two waveguides with sufficient accuracy. Furthermore, the construction of this flange connection is cumbersome and its component parts are heavy and expensive. Finally, there are also problems in soldering on a flange.

SUMMARY OF THE INVENTION

Accordingly one object of the invention is to create a flange connection for round waveguides which achieves coaxiality of two adjoining waveguides with high accuracy, is simple to construct and inexpensive in production. According to the invention, the way of achieving the object consists in the fact that the coaxiality of two round mutually adjoining waveguides is achieved by means of a radially elastic centering ring, the centering ring enclosing one end each of the two waveguides.

According to a preferred embodiment of the invention, the flange connection is constructed in such a manner that it can be joined in the manner of a bayonet lock.

A particularly preferred embodiment of the flange connection allows the latter to be constructed and temporarily fixed without the aid of tools.

A flange connection is furthermore preferred which comprises at least one independent-flange ring which is attached to the waveguide so as to be rotatable but undisplaceable in the axial direction.

The sub-claims provide further embodiments of the flange connection and, in particular, of the centering ring.

BRIEF DESCRIPTION OF THE DRAWINGS

A more complete appreciation of the invention and many of the attendant advantages thereof will be readily obtained as the case becomes better understood by reference to the following detailed description when considered in connection with the accompanying drawings, wherein.

DESCRIPTION OF THE PREFERRED EMBODIMENTS

Figure 1:
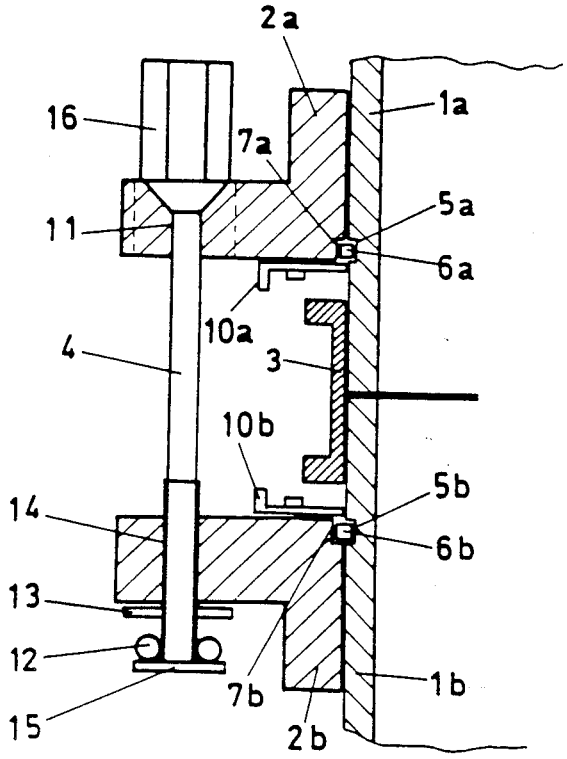
FIG. 1 shows a section through a flange connection.

Referring now to the drawings, wherein like reference numerals designate identical or corresponding parts throughout the several views. FIG. 1 shows a section through a flange connection according to the invention. The starting point is two waveguides 1*a*, 1*b* which are to be coaxially coupled. These are round waveguides of metal such as, for example, phosphorated copper (material DIN 1787), with an outside diameter of about 120 mm and a wall thickness of about 3 mm.

An essential requirement for the waveguide consists in its roundness and its wall thickness exhibiting small production tolerances. If necessary, the waveguides must be brought to a uniform wall thickness at their ends. However, the fact cannot be avoided in the normal case that waveguides to be joined together have different outside radii within the margin of production in accuracy at their ends. It is especially in this case where the invention creates the best possible remedy, assuming the two waveguides meet the abovementioned requirements with respect to roundness and wall thickness.

Waveguides 1*a*, 1*b* exhibit in the vicinity of their ends in each case one circumferential groove 5*a*, 5*b* in which one spring ring 6*a*, 6*b* is located in each case. The spring rings 6*a*, 6*b* protrude from the grooves 5*a*, 5*b* and can be manufactured, for example, from a bronze wire.

The core of the invention then lies in using a centering ring 3 which encloses the two waveguides 1*a*, 1*b* in each case at one of their ends. The centering ring 3 is constructed in such a manner that it develops a spring effect in the radial direction. If then the waveguides 1*a*, 1*b* differ with respect to their outside radii at their ends, the centering ring 3 automatically brings them into a coaxial position.

A flange connection is used for rigidly coupling the two waveguides 1*a*, 1*b*. According to a preferred embodiment of the invention, this connecting looks as follows:

Two flange rings 2*a*, 2*b*, the inside diameters of which are just large enough so that the flange rings 2*a*, 2*b* can be easily displaced with respect to the waveguides 1*a*, 1*b* but so that they cannot slide off over the spring rings 6*a*, 6*b*, are slipped over the waveguides 1*a*, 1*b*.

The flange rings 2*a*, 2*b* can consist, for example, of material DIN 1725 (AlMgSi alloy) and are preferably surface-treated so that they slide better on the waveguides 1a, 1b. In practice, a successful method has been to apply the ematal process (electrolytic treatment in a titanium oxalate bath) to the flange rings. This surface treatment leads to advantageously compact surfaces and is produced, for example, by Contraves AG in Zurich.

The flange rings 2a, 2b have at a side facing the end of the waveguide one circumferential recess 7a and 7b respectively, each which is sufficiently large to be able to accommodate therein the spring ring 6a and 6b respectively. At the flange rings 2a, 2b, several radially displaceable ring holders 10a, 10b are arranged which are distributed over the circumference of the flange ring and which cooperate with the spring ring to form an axial stop for the flange ring. In FIG. 1, only one ring holder per flange ring is drawn in each case.

A number of coupling screws 4, one of which can be seen in FIG. 1, connect the two flange rings 2a, 2b. They have a screw head 16 which is preferably long and hexagonal so that the coupling screw 4 can be easily screwed by hand, and a closed end 15 so that the coupling screws 4 cannot be lost. An elastic ring 12 and a washer 13 are located underneath the closed end 15. The elastic ring 12 ensures that the coupling screw 4 still has some free play even when it is screwed forward as far as possible in the direction of the waveguide 1a. The coupling screw 4 is provided with a thread on the side of the closed end 15. Correspondingly, the flange ring 2b has a threaded bushing 14 at this point. A bayonet hole 11 in the flange ring 2a opposite the threaded bushing 14 corresponds to a preferred embodiment of the invention and provides the possibility of a simple construction of the flange connection.

Figure 2:
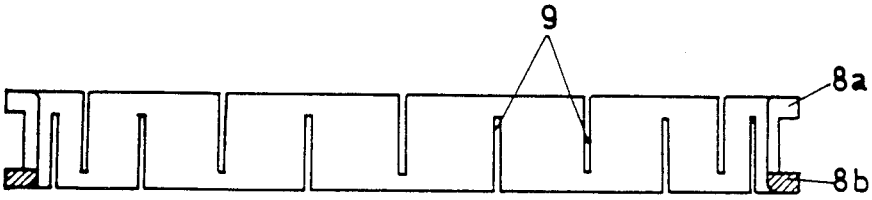
FIG. 2 shows an axial section through a centering ring.

FIG. 2 shows an axial section through a centering ring according to the invention. The centering ring is, for example, of metal, preferably of material DIN 1725 treated with the ematal process and has an inside diameter which is slightly smaller than the outside diameter of the waveguides to be coupled so that it can enclose the latter without play. A radial spring effect is achieved by the fact that the centering ring is provided with slots 9 which extend parallel with respect to the axis of the centering ring. The slots 9 penetrate alternately from below and from above down to a given depth. In this exemplary embodiment, the slots 9 are arranged at an azimuthal distance of 15°.

According to a preferred embodiment of the invention, the centering ring has centering ring flanges 8a, 8b at the top and at the bottom. Furthermore, the slots 9 coming from above penetrate down to the lower centering ring flange 8b and those coming from below penetrate up to the upper centering ring flange 8a. The centering ring flanges 8b increase the deformation resistance below the slots 9 of the centering ring coming from above. This can be said mutatis mutandis for the centering ring flanges 8a.

The width of the centering ring has to be defined in such a manner that, on the one hand, the waveguides are enclosed over a sufficiently great width in order to obtain the effect according to the invention and that, on the other hand, the flange connection overall takes up as little space as possible. In the present example, the width of the centering ring is about 15 mm. In general, width of the centering ring, dimension of the centering ring flanges and number and type of slots must be adapted to the respective requirements.

Figure 3A:
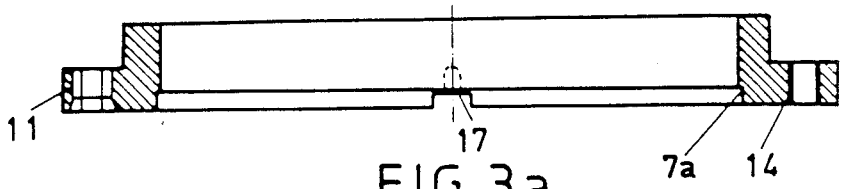
FIG. 3*a* shows an axial section through a flange ring.
Figure 3B:
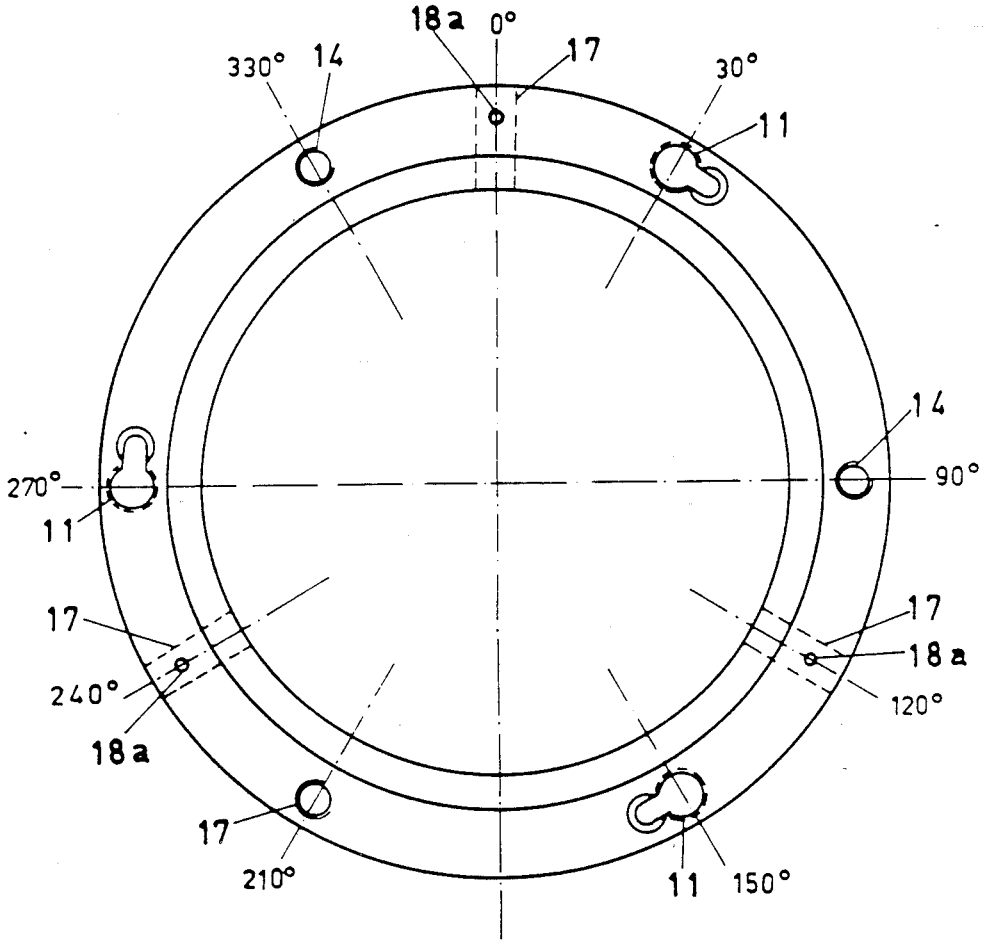
FIG. 3*b* shows a top view of this flange ring.

FIG. 3a shows a flange ring according to the invention in an axial section and FIG. 3b shows a top view of the latter. In FIGS. 3a and 3b, the threaded bush 14, the bayonet hole 11 and the circumferential recess 7a can be seen again. FIG. 3b shows, in particular, how the threaded bushings 14 and the bayonet holes 11 can be arranged. In this example, three threaded bushings and three bayonet holes 11 are alternately arranged at an azimuthal distance of 60°. In each of the threaded bushings 14, a captive coupling screw 4 is located as described above.

The advantage of applying threaded bushes 14 and bayonet holes 11 to a flange ring in the manner described above lies in the fact that the flange connection can be constructed with two identical flange rings 2a, 2b. This simplifies production and construction of the flange connection.

According to a preferred embodiment of the invention, the flange ring is equipped with guide grooves 17 for the ring holders 10. In each groove, furthermore, a hole 18a is located so that the ring holders 10 can be secured by means of a screw.

Figure 4:
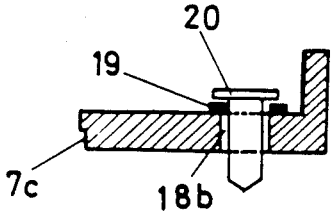
FIG. 4 shows a section through a ring holder.

FIG. 4 shows a section through a ring holder. An oval hole 18b is provided for securing the ring holder to a flange ring by means of a screw 20. A spring washer 19 is placed underneath the screw 20 and ensures that the ring holder is held tight in its respective position. The ring holder is preferably L-shaped so that it can be easily pushed forward and back without using a tool. Similarly, it has a an end facing the waveguide a recess 7c which can accommodate the part of a spring ring protruding from the groove of the waveguide when the ring holder is in its pushed-forward state (compare FIG. 1).

The text which follows describes the construction of a flange connection in accordance with the invention.

A round waveguide 1a, which exhibits a circumferential groove 5a at a suitable distance from one end, meets the desired requirements for production accuracy both with respect to roundness and with respect to wall thickness. A flange ring 2a with captive coupling screws 4 and ring holders 10a, as is shown, for example, in FIG. 3b, is slipped over the end of the waveguide 1a. After that, a spring ring 6a is placed into the groove 5a of the waveguide. The flange ring 2a is pushed forward to the spring ring 6a and fixed in this position by pushing forward the ring holders 10a, which prevents the flange ring 6a from sliding back towards a center of the waveguide 1a. Naturally, the flange ring can still be axially rotated around the waveguide 1a in this arrangement.

The coupling screw 4 are screwed forward until the elastic ring 12 is clamped between the closed end 15 and the washer 13. Because of the elastics ring 12, the coupling screw 4 is not rigid on the flange ring but can be slightly moved. Production inaccuracies of bayonet holes 11 of an opposite flange ring can be accommodated in this manner.

A similar procedure is adopted with a second waveguide 1b to be coupled to the end of the first waveguide 1a.

A centering ring 3 is now half slipped over the end of one waveguide 1a. With a suitable choice of the distance of the groove 5a, the centering ring 3 can be pushed over the waveguide 1a until it abuts against the flange ring 2a and then just encloses the waveguide 1a with approximately half its width.

Because of the radial spring effect, the centering ring 3 is clamped against the waveguide 1*a*. It is to be noted that both hands are now free for taking the second waveguide 1*b*, to push it into the centering ring 3 and to rotate it into the required direction (thinking of the case where the waveguide 1*b* is curved), to close the bayonet lock and to screw the coupling screws 4 manually shut to such an extent that the flange connection is temporarily fixed. Now both hands are free again to finally tighten the coupling screws 4, for example by means of a wrench.

Apart from the fact of the coaxial connection of the waveguides 1*a*, 1*b*, it is of great significance in practice that a flange connection according to the invention can be constructed a leas temporarily without tools by using two hands, that is to say by one person. It is particularly clever to construct, for example, ring holders or the lock of a coupling screw in such a manner that they do not offer any point of attack for tools such as screwdrivers or wrenches so that these parts cannot be detached by mistake.

The manner described above of securing a flange ring by means of a spring ring inserted in a groove makes the flange connection very flexible. For example, it is possible to provide the waveguides as a standard measure with a plurality of suitably applied grooves so that each waveguide is compatible with several different coupling arrangements (external systems, vacuum closures and so forth) in accordance with a module principle.

It can be finally said that the connection according to the invention coaxially connects round waveguides and that it is extremely simple to construct.

Obviously, numerous modifications and variations of the present invention are possible in the light of the above teachings. It is therefore to be understood that, within the scope of the appended claims, the invention may be practiced otherwise than as specifically described herein.

What is claimed as new and desired to be secured by Letters Patent of the United States is:

1. A flange connection for connecting a first and a second waveguide, comprising:

a first and second independent flange ring, which are attached to one end of the first and the second waveguides for joining said first and second waveguides, respectively;

a radially elastic centering ring enclosing each of said one ends of the waveguides, so as to produce coaxiality of the two waveguides;

wherein:

said centering ring is provided with slots which extend parallel with respect of the axis of the centering ring and which alternatively penetrate from a first and a second edge of said centering ring, so as to achieve a radial spring effect.

2. A flange connection as claimed in claim 1 wherein each of said flange rings is connected by a flange connection to a respective one of said waveguides so as to be fixed in an axial direction of said waveguide and freely rotatable about said waveguide, said flange connection comprising:

a circumferential groove formed in a respective one of said waveguides;

a spring ring protrudingly fitted in said groove; and flange ring holders mounted to said waveguide and cooperating with said spring ring to form an axial stop means for said flange ring.

3. A flange connection as claimed in claim 2 including bayonet lock means on said flanges.

4. A flange connection as claimed in claim 3, wherein (a) the two flange rings are identical, (b) each flange ring being equipped with a number of captive coupling screws, and (c) the coupling screws, which are tuned out up to a stop for constructing the flange connection, have sufficient free play to be able to accommodate production inaccuracies of bayonet holes.

5. A flange connection as claimed in claim 4, wherein the coupling screws have a hexagonal head and a closed end under which an elastic ring is located so that the coupling screws also have sufficient free play at the stop.

6. A flange connection for connecting first and a second waveguide, comprising;

a first and a second independent flange ring, which are attached to one end of the first and the second waveguide respectively, for joining said first and second waveguides, respectively;

a radially elastic centering ring enclosing each of said one ends of the waveguides, so as to produce coaxiality of the two waveguides;

wherein:

said centering ring has an upper and a lower centering ring flange and is provided with slots which extend parallel with respect of the axis of the centering ring and which alternatively penetrate to the upper and the lower centering ring flange, so as to achieve a radial spring effect.

7. A flange connection as claimed in claim 6 wherein each of said flange rings is connected by a flange connection to a respective one of said waveguides so as to be fixed in an axial direction of said waveguide and freely rotatable about said waveguide, said flange connection comprising:

a circumferential groove formed in a respective one of said waveguides;

a spring ring protrudingly fitted in said groove; and flange ring holders mounted to said waveguide and cooperating with said spring ring to form an axial stop means for said flange ring.

8. A flange connection as claimed in claim 7 including bayonet lock means on said flanges.

9. A flange connection in claim 8, wherein (a) the two flange rings are identical, (b) each said flange being equipped with a number of captive coupling screws, and (c) the coupling screws, which are turned out up to a stop for constructing the flange connection, have sufficient free play to be able to accommodate production inaccuracies of bayonet holes.

10. A flange connection as claimed in claim 9, wherein the coupling screws have a hexagonal head and a closed end under which an elastic ring is located so that the coupling screws also have sufficient free play at the stop.

11. A flange connection for connecting a first and a second waveguide, comprising:

a first and a second independent flange ring, which are attached to one end of the first and the second waveguide respectively, for joining said first and second waveguides, respectively;

a radially elastic centering ring made of an aluminum alloy enclosing each of said one ends of the waveguides, so as to produce coaxiality of the two waveguides;

wherein:

said centering ring has an upper and a lower centering ring flange and is provided with slots which extend parallel with respect of the axis of the centering ring and which alternatively penetrate to the upper and the lower centering ring flange, so as to achieve a radial spring effect.

12. A flange connection as claimed in claim 11 wherein each of said flange rings is connected by a flange connection to a respective one of said waveguides so as to be fixed in an axial direction of said waveguide and freely rotatable about said waveguide, said flange connection comprising:

a circumferential groove formed in a respective one of said waveguides;

a spring ring protrudingly fitted in said groove; and flange ring holders mounted to said waveguide and cooperating with said spring ring to form an axial stop means for said flange ring.

13. A flange connection as claimed in claim 12 including bayonet lock means on said flanges.

14. A flange connection as claimed in claim 13, wherein (a) the two flange rings are identical, (b) each said flange ring being equipped with a number of captive coupling screws, and (c) the coupling screws, which are turned out up to a stop for constructing the flange connection, have sufficient free play to be able to accommodate production inaccuracies of bayonet holes.

15. A flange connection as claimed in claim 14, wherein the coupling screws have a hexagonal head and a closed end under which an elastic ring is located so that the coupling screws also have sufficient free play at the stop.

* * * * *